US005277208A

United States Patent [19]

Mansur

[11] Patent Number: 5,277,208

[45] Date of Patent: Jan. 11, 1994

[54] MULTI-PROCESS POWER SPRAY WASHER APPARATUS

[76] Inventor: Pierre G. Mansur, 12210 SW. 130th St., Miami, Fla. 33186

[21] Appl. No.: 884,406

[22] Filed: May 18, 1992

[51] Int. Cl.[5] ..... B08B 3/02; B08B 13/00

[52] U.S. Cl. ..... 134/56 R; 134/99.2; 134/107; 134/108; 134/109; 134/111; 134/153; 210/167; 210/297; 210/387

[58] Field of Search ..... 134/56; 210/167, 297, 210/387

[56] References Cited

U.S. PATENT DOCUMENTS

| | | | |
|---|---|---|---|
| 3,378,018 | 4/1968 | Lanter | 134/109 |
| 3,624,750 | 11/1971 | Peterson | 134/153 X |
| 3,765,430 | 10/1973 | Muller | 134/109 |
| 4,143,669 | 3/1979 | Minkin | 134/153 |
| 4,217,920 | 8/1980 | Ballard | 134/153 X |
| 4,652,368 | 3/1987 | Ennis et al. | 134/109 X |
| 4,769,158 | 9/1988 | Eckert | 210/297 X |
| 4,948,502 | 8/1990 | Anderson | 210/387 |

FOREIGN PATENT DOCUMENTS

| | | | |
|---|---|---|---|
| 710672 | 2/1980 | U.S.S.R. | 134/109 |
| 761035 | 9/1980 | U.S.S.R. | 134/109 |

*Primary Examiner*—Philip R. Coe
*Attorney, Agent, or Firm*—Malloy & Malloy

[57] ABSTRACT

A self-contained and integrated multi-process power spray washer apparatus to be used to clean articles placed therein, the washer apparatus including a central washing chamber which is large enough to enclose and rotate an article to be cleaned therein. A primary filter removes contaminants from a cleaning solution immediately after it has been used, and a solution reservoir receives and holds filtered cleaning solution from the primary filter. A fan forced electronic burner heats the cleaning solution contained in the reservoir, and provides a heat source for contaminant incineration. An oil skimmer removes oil and grease from an upper surface of the cleansing solution held in the reservoir, and a secondary centrifugal filter through which cleansing solution is pumped from the reservoir additionally filters the solution. A high power sprayer sprays the recycled and clean cleansing solution into the washing chamber at a substantially high volume and pressure so as to substantially clean the item contained within the washing chamber. A fresh water rinse cycle provides for a final fresh water rinse of the article being cleaned and the recycling of the contaminated water prior to reuse or proper drainage. Accordingly, three steps of a cleaning process associated with the present invention include spray washing, recycling and disposal which are fully integrated in the self contained power spray washer apparatus.

14 Claims, 1 Drawing Sheet

MULTI-PROCESS POWER SPRAY WASHER APPARATUS

BACKGROUND OF THE INVENTION

Field of the Invention

This invention relates to a self-contained and integrated multi-process power spray washer apparatus, to be used to clean any and all parts or articles placed therein, and is structured to power spray wash parts, filter and recycle cleansing solutions, and dispose of all contaminant by-product, thereby providing a cost efficient, highly effective, and environmentally acceptable means of cleaning engine parts and the like which require thorough cleaning prior to use.

Summary of the Invention

The present invention is directed towards a self-contained and integrated multi-process power spray washer apparatus to be used to clean any and all parts placed therein. The apparatus includes primarily a central washing chamber which is sufficiently large to enclose and rotate completely the item to be cleaned, thereby utilizing the cleansing solution at a substantially high pressure and volume which maximizes the effects of the cleaning. Additionally, the washer apparatus includes a primary filter which is structured and disposed to receive used cleansing solution from the central washing chamber and substantially remove contaminants therefrom. This primary filter is interconnected with a solution reservoir such that the filtered cleansing solution may flow therefrom into the solution reservoir. Within the solution reservoir, the cleansing solution is heated by an integrated burner so as to maximize the effects of the cleansing solution. The cleansing solution within the solution reservoir is further cleaned by an oil skimmer which removes oil and grease from the cleansing solution. Further included as part of the washer apparatus is a secondary centrifugal filter. This secondary centrifugal filter is structured such that cleansing solution is pumped from the solution reservoir therethrough, wherein the solution is further cleansed of contaminants. After passing through the secondary centrifugal filter, the cleansing solution is pumped through a high power sprayer which sprays the cleansing solution into the washing chamber at substantially high volumes and pressures, thereby cleaning the item contained within the washing chamber.

The object of the present invention is to provide a power spray washing apparatus which will thoroughly clean any and all parts, including engine blocks and the like, which often have large quantities of dirt, grease, and contaminants built up thereon.

Another object of the present invention is to provide a spray washer apparatus which enables the cleansing solution to be recycled and reused, yet be effective throughout all of the multiple uses.

Yet another object of the present invention is to provide a power spray washer apparatus which is environmentally acceptable and eliminates contaminant waste.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
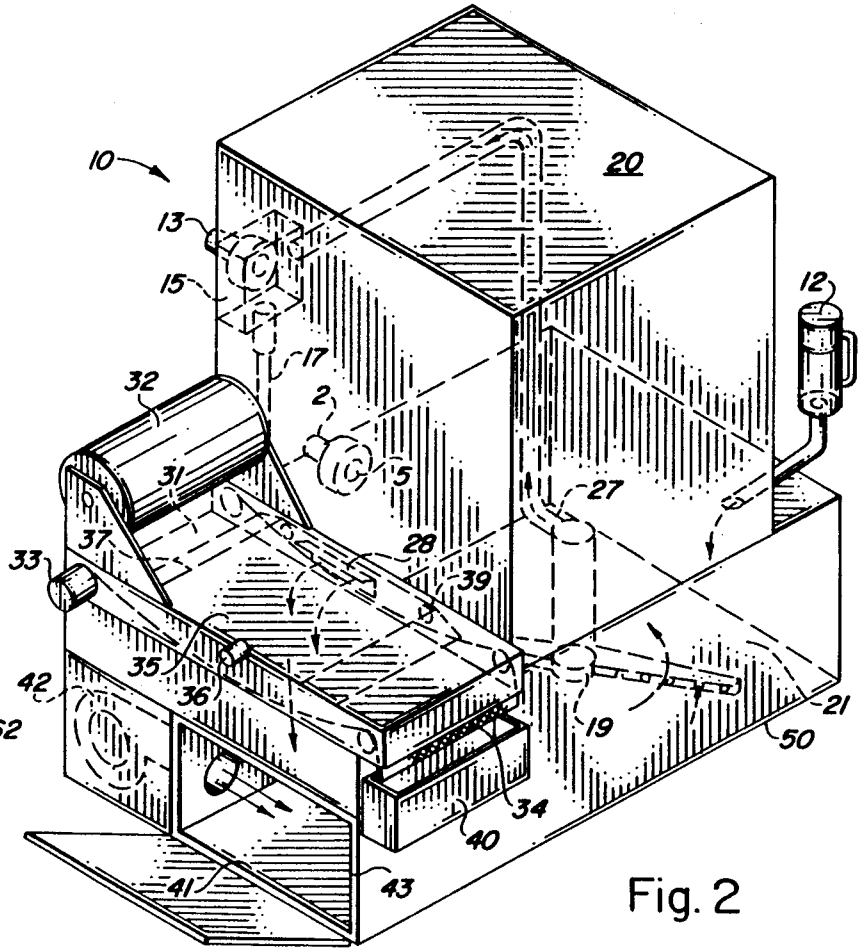
FIG. 2 is a partial cutaway, side view of the power spray washer apparatus.
Figure 1:
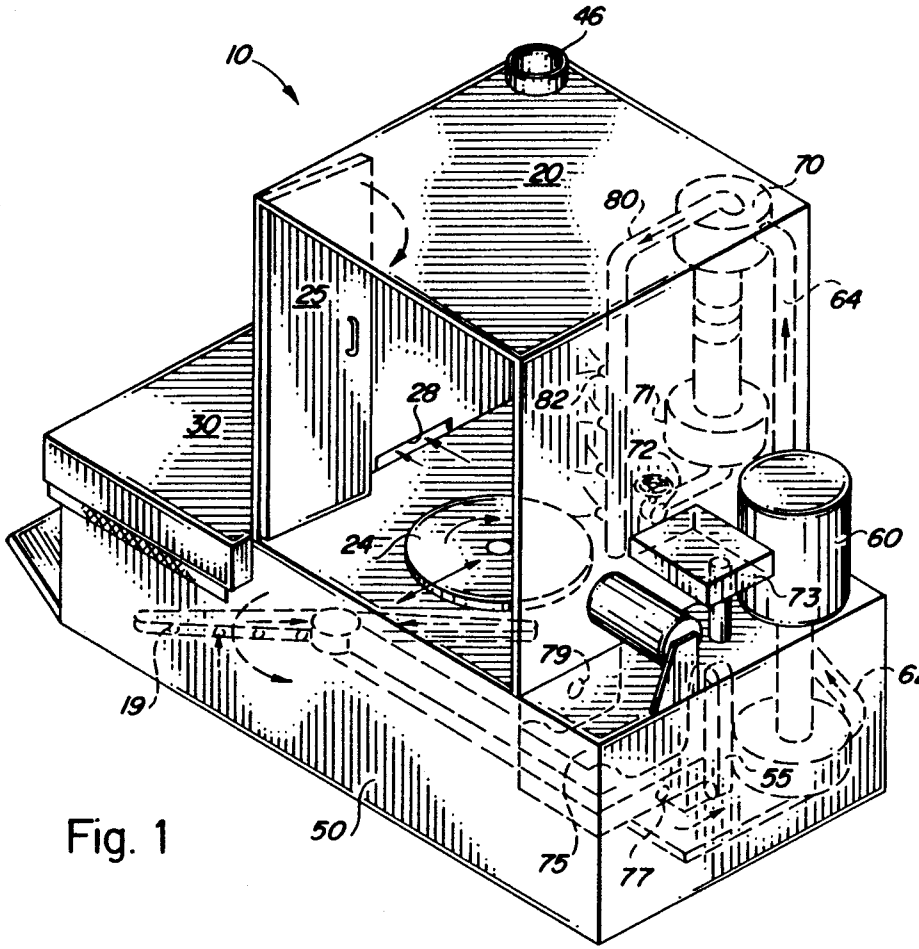
FIG. 1 is a front, partial cutaway, perspective view of the power spray washer apparatus.

Shown in FIGS. 1 and 2, the present invention is directed towards a self-contained and integrated multi-process power spray washer apparatus, generally indicated as 10, to be used to thoroughly clean any and all parts which may have substantial dirt, grease, and contaminants built up thereon. The spray washer apparatus 10 includes a large central washing chamber 20 capable of completely enclosing the item to be cleaned. Located within the central washing chamber 20 is a pull out, rotating turntable 24 which is structured to be able to support objects of substantial weight thereon. The rotating turntable 24 is structured such that all sides of the item to be cleaned will be thoroughly sprayed, and as it may be easily pulled out and slid back within the washing chamber 20, the large and heavy items to be cleaned may be conveniently positioned thereon before insertion into the washing chamber 20. In order to assure maximum sealing efficiency within the washing chamber 20, and in order to minimize the floor space required for the spray washer apparatus 10, a pair of inwardly opening doors 25 are utilized to allow access into the washing chamber 20. Included at a lower portion of the washing chamber 20 is a drainage opening 28. The drainage opening 28 is structured such that cleansing solution used within the washing chamber 20 may flow therethrough into a primary filter 30. The primary filter 30 utilizes a filtration sheet 31 which is structured to remove a majority of the contaminants contained in the used cleansing solution, and allow passage of the filtered cleansing solution therethrough. The filtration sheet 31 is positioned at a distal end 32 thereof on an automatic roller 33 which contains the clean filtration sheet 31. The filtration sheet 31 is positioned so as to pass substantially over a drainage area 35. Used cleansing solution flows into the drainage area 35 and is filtered by the filtration sheet 31, however, since the portion of the filtration sheet 31 which is over the drainage area 35 will eventually become saturated with contaminants, a fluid level meter 36 is included over the drainage area 35 such that when a predetermined quantity of cleansing solution backs up within the drainage area 35, thereby indicating the filtration sheet 31 is saturated, it will trigger the automatic roller 33. Once triggered, the automatic roller 33 causes a clean portion of the filtration sheet 31 to be positioned atop the drainage area 35, and causes the saturated proximate end 34 of the filtration sheet 31 to pass into a disposal holding area 40. Further, suction fan 2 located in cleansing solution reservoir 50 provides negative pressure to augment the flow of cleansing solution through filtration sheet 31. Additionally, a safety release overflow outlet 39 above filtration sheet 31 and a hood 37 encapsulating the drainage area 35 prevent any overflows.

After passage through the drainage area 35, the filtered cleansing solution passes into the solution reservoir 50 positioned beneath the washing chamber 20. The contaminant saturated portion 34 of the filtration sheet 31 after passage into the disposal holding area 40 can be removed and positioned within a heavy duty incinerator chamber 41, having ceramic lining 43, wherein the saturated portion 34 of the filtration sheet 31 will be incinerated by a fan forced burner 42. The incineration formed by this process passes through an exhaust duct 46 and out of the spray washer apparatus 10. In addition to incinerating the filtration sheet 31, the fan forced burner 42 also functions as heating means to heat cleansing solution held within the solution reservoir 50, thereby maximizing the efficiency of the cleansing solution. Once within the solution reservoir 50, an oil skimmer 55 is utilized to remove remaining oil or contaminants from the cleansing solution. The above steps are part of what may be referred to as a cleansing cycle or operation. After the cleansing cycle or operation, to be described in even greater detail hereinafter, has been completed, a filtering cycle may be started by adding flocculent and/or coagulant chemical catalysts contained in catalyst holding tank 12 into the cleaning solution reservoir 50 so as to react with the cleaning solution and initiate the coagulant and/or flocculent chemical process which coagulates or flocculates the finer contaminants for pick up by the mechanical, rotating 360° sweep 19 which may again be activated during the filtering cycle. The rotating sweep 19 once again activated directs the contaminated solution into an upper portion of the washing chamber 20 through a diverter flow tube 27, and into a suction and discharge chamber 15. This flow is induced by a suction mechanism 13 which creates a desired turbulent free flow of the solution for discharge through discharge opening 17 into drainage opening 28 therethrough into primary filter 30 so as to separate the flocculated and/or coagulated contaminants from the recycled solution.

However, during the cleansing cycle or operation the cleansing solution containing gravity settled contaminants is picked up from the solution reservoir 50 through mechanical rotating 360° sweep 19 at the extreme solution reservoir 50 bottom into pump 60, and through solution conduits 62 and 64 into a secondary centrifugal filter 70. The secondary centrifugal filter 70 revolves the cleansing solution at high speeds causing any remaining contaminated cleansing solution to pass to a lower portion 71 thereof, and out through a drainage outlet 72. This contaminated cleansing solution passes from the drainage outlet 72 into an extremely fine filter element 73 so as to separate the contaminants from the recycled solution which is automatically directed back to the holding tank 50. After passage through the secondary centrifugal filter 70, the clean, reused cleansing solution passes into a high power sprayer 80. The high power sprayer 80 includes a plurality of nozzles 82 which are structured to optimize a solution spray pattern into the central washing chamber 20. After introduction of the cleansing solution into chamber 20, and the cleaning of an item therein, an additional part of the cleansing cycle includes a fresh water rinse cycle, performed within central washing chamber 20. After rinsing the item being cleaned, the initially fresh rinse water, now containing contaminants, is routed or allowed to drain through a diverter door 5 on the drainage opening 28 which directs contaminated fresh water rinse fluid through a discharge tube to entry 79 and into a rinse cycle filter 75 which combines a filter roll element plus heavy metal removal media, with activated charcoal discharged from the apparatus 10 through a discharge opening 77. Contaminants within the rinse water are thereby properly eliminated. Conveniently positioned outside of the central washing chamber 20 is a control panel which includes a plurality of gauges to check solution temperature, levels and the like, and may further be programmed to perform automated, timed cleaning cycles. Finally, the entire power spray washer apparatus 10 is heavily polyurethane insulated to reduce heat emission and retain the cleansing solution at a desired temperature.

Now that the invention has been described, what is claimed is:

1. To be used to power clean any and all parts, a self-contained and integrated multi-process power spray washer apparatus comprising:

a central washing chamber, said chamber being sufficiently large to enclose an item to be cleaned therein, a primary filter, said primary filter structured to remove flocculated and/or coagulated contaminants from a cleansing solution, a solution reservoir, structured to receive the filtered cleansing solution from said primary filter, heating means to heat said cleansing solution in said reservoir, an oil skimmer structured and disposed to remove remaining oil and grease from said cleansing solution in said reservoir, a secondary centrifugal filter through which said cleansing solution is pumped, said secondary centrifugal filter being structured to remove additional contaminants from said cleaning solution prior to reuse, and a high power sprayer to spray said cleansing solution, after passage through said secondary centrifugal filter, into said washing chamber at a substantially high volume and high pressure so as to clean the item contained within said chamber.

2. An apparatus as recited in claim 1 wherein said central washing chamber includes a pull out, rotating turntable whereon said item to be cleaned may be positioned and rotated within said chamber so as to place all sides of said item under the direct spray of said high power sprayer.

3. An apparatus as recited in claim 2 wherein said turntable is capable of supporting thereon items of substantial weight.

4. An apparatus as recited in claim 3 wherein said central chamber includes a pair of inwardly opening doors structured and disposed to maximize sealing efficiency and minimize floor space requirements.

5. An apparatus as recited in claim 4 wherein said primary filter includes a filtration sheet pulled from a roll on an automatic roller and across a drainage area, a used portion thereof being discarded into a disposal holding area.

6. An apparatus as recited in claim 5 wherein said drainage area includes a fluid level meter means positioned so as to detect when said cleansing solution attains a predetermined height and said filtration sheet has become saturated by contaminants and will no longer allow passage of filtered cleanser therethrough into said solution reservoir, and said meter triggering said automatic roller when the fluid level reaches the predetermined height so as to move a fresh area of said filtration sheet from said roll over said drainage area and direct saturated areas of said filtration sheet into said disposal holding area.

7. An apparatus as recited in claim 6 wherein said heating means includes a fan forced electronic burner.

8. An apparatus as recited in claim 7 further including a disposal incineration area having a heavy duty, ceramic lined incinerator, exhaust means, and being structured and disposed to incinerate said saturated filtration paper using said electronic burner.

9. An apparatus as recited in claim 8 further including a mechanical rotating 360° sweep suction mechanism at an extreme bottom of said solution reservoir to assist the flow of contaminants and cleansing solution throughout said apparatus.

10. An apparatus as recited in claim 9 wherein said secondary centrifugal filter is structured and disposed to direct contaminants to a lower portion thereof, and send filtered cleansing solution into said high power sprayer.

11. An apparatus as recited in claim 10 wherein said lower portion of said secondary filter includes a drainage outlet to direct the contaminants into a fine filter element so as to separate the contaminants from the recycled solution prior to being directed back into said solution reservoir.

12. An apparatus as recited in claim 11 further including a chemical catalyst added into said solution reservoir to chemically induce removal of contaminants from the cleansing solution.

13. An apparatus as recited in claim 12 which includes an integral fresh water rinse cycle with provisions for diverting fresh water rinse through several stages of filtration removing the majority of contaminants for reuse or proper drainage.

14. An apparatus as recited in claim 13 wherein said high power sprayer includes a plurality of nozzles structured and disposed to optimize a solution spray pattern.

* * * * *